US005870126A

United States Patent [19]

Kondo et al.

[11] Patent Number: 5,870,126

[45] Date of Patent: Feb. 9, 1999

[54] INK JET PRINTER HAVING BUBBLE PURGE MECHANISM

[75] Inventors: Norimasa Kondo; Takao Matsuoka; Shigenori Suematsu; Kazunobu Hayashi, all of Hitachinaka, Japan

[73] Assignee: Hitachi Koki Co., Ltd., Tokyo, Japan

[21] Appl. No.: 586,237

[22] Filed: Jan. 16, 1996

[30] Foreign Application Priority Data

Jan. 20, 1995 [JP] Japan ..... 7-007318

[51] Int. Cl.[6] ..... B41J 2/175

[52] U.S. Cl. ..... 347/92; 347/89

[58] Field of Search ..... 347/92, 89, 90, 347/91

[56] References Cited

U.S. PATENT DOCUMENTS

| | | | |
|---|---|---|---|
| 4,320,407 | 3/1982 | Goldis et al. | 347/92 |
| 4,462,037 | 7/1984 | Bangs et al. | 347/89 |
| 4,476,472 | 10/1984 | Aiba et al. | 347/92 |
| 4,607,261 | 8/1986 | McCann et al. | 347/89 |
| 4,680,696 | 7/1987 | Ebinuma et al. | 347/89 |
| 4,727,378 | 2/1988 | Le et al. | 347/92 |
| 4,737,801 | 4/1988 | Ichihashi et al. | 347/92 |
| 5,189,438 | 2/1993 | Hine et al. | 347/92 |
| 5,331,339 | 7/1994 | Takahashi | 347/89 |
| 5,455,615 | 10/1995 | Burr et al. | 347/92 |
| 5,459,497 | 10/1995 | Manning et al. | 347/89 |
| 5,481,284 | 1/1996 | Kitahara et al. | 347/92 |

FOREIGN PATENT DOCUMENTS 512042 3/1993 Japan .

*Primary Examiner*—Peter S. Wong
*Assistant Examiner*—K. Shin
*Attorney, Agent, or Firm*—Whitham, Curtis & Whitham

[57] ABSTRACT

An ink jet printer having bubble purging arrangement for discharging bubbles mixed in the ink out of a print head. The print head has a main tank for storing ink, a sub tank for collecting and storing ink, and a manifold fluidly connecting the main tank and the sub tank. The manifold is in fluid communication with the nozzles for supplying ink from the main tank to the nozzles. Three kind of purging modes are provided in accordance with purging position of the print head. Pressurizing pump is selectively connected to the main tank or sub tank or both main tank and the sub tank through a valve arrangement. If the pump is fluidly connected to the main tank only, the ink in the main flows into the sub tank. If the pump is fluidly connected to the sub tank only, the ink in the sub tank flows back into the main tank. By alternating the fluid connection, bubbles mixed in the ink is gradually concentrated at an upper portion of the manifold. If the pump is fluidly connected to both the main tank and the sub tank, the concentrated bubbles is positively discharged outside through the nozzles.

17 Claims, 6 Drawing Sheets

FIG. 6(a)
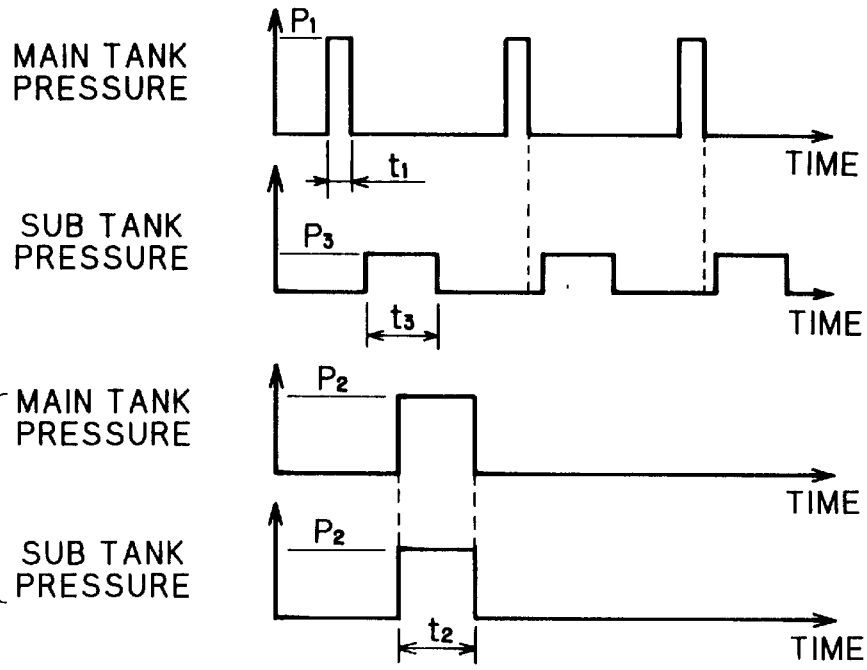
FIG. 6(b)
FIG. 6(c)
FIG. 7
PRIOR ART
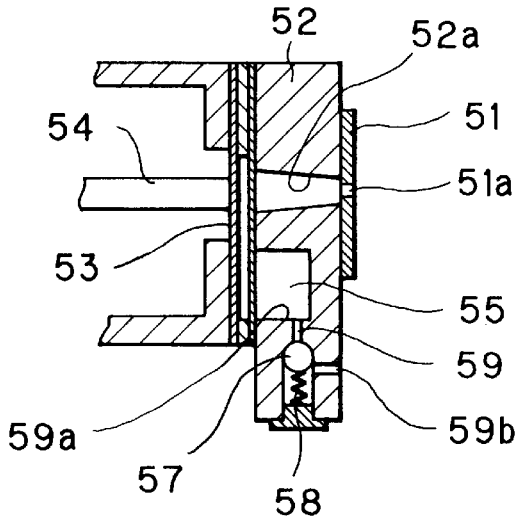

INK JET PRINTER HAVING BUBBLE PURGE MECHANISM

BACKGROUND OF THE INVENTION

The present invention relates to an ink jet printer having a bubble purge mechanism.

A print head of a conventional ink jet printer is shown in FIG. 7. The print head includes a nozzle plate 51, and a main body 52. The nozzle plate 51 is formed with a nozzle 51*a* from which ink is ejected. The main body 52 is formed with a chamber 52*a* in fluid connection with the nozzle 51*a*. A manifold 55 is defined in the main body 52 for supplying ink to the chamber 52*a*. The manifold 55 is in fluid connection with an ink tank (not shown) storing ink. A diaphragm 53 fluidly connects the chamber 52*a* with the manifold 55.

A piezoelectric element 54 is disposed at a position to the rear of the diaphragm 53 and in opposition with the chamber 52*a*. The print head is connected to a control portion (not shown). The control portion supplies control signals for actuating the piezoelectric element 54, which deforms to protrude toward the chamber 52*a*. The deformation of the piezoelectric element 54 applies pressure to the diaphragm 53, thereby transmitting the pressure to the chamber 52*a*. The increase in pressure in the chamber 52*a* ejects ink from the chamber 52*a* through the nozzle 51*a* as an ink droplet.

There has been known a problem in that bubbles mixed with the ink can absorb some of the pressure applied by the piezoelectric element 54 to the chamber 52*a*. The remaining pressure may be insufficient for ejecting an ink droplet. This can result in poor quality of printed characters and images. It is therefore desirable that bubbles be prevented from entering the chamber 52*a*.

For purging bubbles, a check valve mechanism including a ball 57 and a spring 58 are provided. A discharge passage 59 having a valve port 59*a* and a discharge port 59*b* is formed in the main body 52. The discharge passage 59 is in selective fluid communication with the manifold 55 by the action of the check valve mechanism. To purge bubbles, the ink tank (not shown) is subjected to a controlled pressure so that the a controlled ink pressure can be applied into the manifold 55. If the applied ink pressure is insufficient, the mixture of ink and bubbles in the manifold 55 is discharged outside through the nozzle 51*a*. On the other hand, if sufficient ink pressure is applied, the mixture of ink and bubbles is ejected through the nozzle 51*a* as well as through the discharge port 59*b* because the ink pressure overcomes the biasing force of the spring 58 so that the ball 57 is moved away from the valve port 59*a*.

In summary, the discharge port 59*b* can enhance bubble discharging ability, because the bubbles may not be sufficiently discharged through the nozzles 51*a* due to their small cross-sectional area. If high ink pressure is applied, most of the bubbles can be discharged through the discharge port 59*b*. Then, bubbles remaining in the nozzles 51*a* can be discharged outside through the nozzles 51*a* by applying low ink pressure.

There is a problem with this mechanism in that a great deal of ink must be ejected to purge bubbles. This wastes ink. To reduce the amount of wasted ink, several methods have been proposed which involve selectively switching between high and low pressure and varying the duration and number of pressurization. Still however, the conventional methods always discharge ink outside when purging. Therefore, ink wasting problem still remains unsolved.

SUMMARY OF THE INVENTION

It is therefore, an object of the present invention to overcome the above-described problems and to provide a bubble purge mechanism which effectively purges bubbles with minimal loss of ink and which has very few components so that it is simple and inexpensive to produce.

This and other object of the present invention will be attained by providing an ink jet printer for ejecting ink from nozzles, the ink jet printer including a print head, a drive mechanism and means for introducing a compressed gas. The print head has a main tank for storing ink, a sub tank for collecting and storing ink, and a manifold fluidly connecting the main tank and the sub tank. The manifold is in fluid communication with the nozzles for supplying ink from the main tank to the nozzles. The manifold has a part which is the highest among a remaining part of the manifold, the main tank and the sub tank for providing a bubble concentrating space. The drive mechanism is adapted for reciprocally moving the print head in a line extending direction for printing. The introducing means is adapted for introducing a compressed gas selectively to the main tank only for flowing the ink in the main tank to the sub tank, to the sub tank only for flowing back the ink in the sub tank to the main tank, and to both the main tank and the sub tank for ejecting, through the nozzles, the bubbles concentrated at the bubble concentrating space in accordance with a position of the print head provided by the drive mechanism.

In another aspect of the invention, there is provided an ink jet printer for ejecting ink from nozzles, the ink jet printer comprising a side wall member, a print head, a drive mechanism, pressure supplying mechanism, pressure connection means, and control means. The print head has a main tank for storing ink, a sub tank for collecting and storing ink, and a manifold fluidly connecting the main tank and the sub tank. The manifold is in fluid communication with the nozzles for supplying ink from the main tank to the nozzles. The drive mechanism is adapted for reciprocally moving the print head in a line extending direction for printing. The drive mechanism further provides first, second and third purging positions of the print head with respect to the side wall member for selectively performing first, second and third purging operation. The pressure supplying means is adapted for supplying compressed gas to the main tank and the sub tank. The pressure connection means is adapted for fluidly connecting the pressure supplying means with one of the main tank and the sub tank and both the main tank and the sub tank in accordance with the purging position of the print head. The ink in the main tank flows into the sub tank when the pressure supplying means and the main tank are connected to each other in the first purging operation. The ink in the sub tank flows back to the main tank when the pressure supplying means and the sub tank are connected to each other in the third purging operation. The pressure supplying means is connected to both the main and sub tanks in the second purging operation. The control means is connected to the drive mechanism, the pressure supplying means and the pressure connection means for providing one of the purging positions of the print head.

BRIEF DESCRIPTION OF THE DRAWINGS

In the drawings:

FIGS. 6(*a*) through 6(*c*) are time charts showing duration and relative timing of various pressurizing operations performed during bubble purge; and FIG. 7 is a cross-sectional view showing a conventional print head.

DETAILED DESCRIPTION OF THE PREFERRED EMBODIMENTS

An ink jet printer with a bubble purge mechanism according to a preferred embodiment of the present invention will be described with reference to the drawings.

Figure 1:
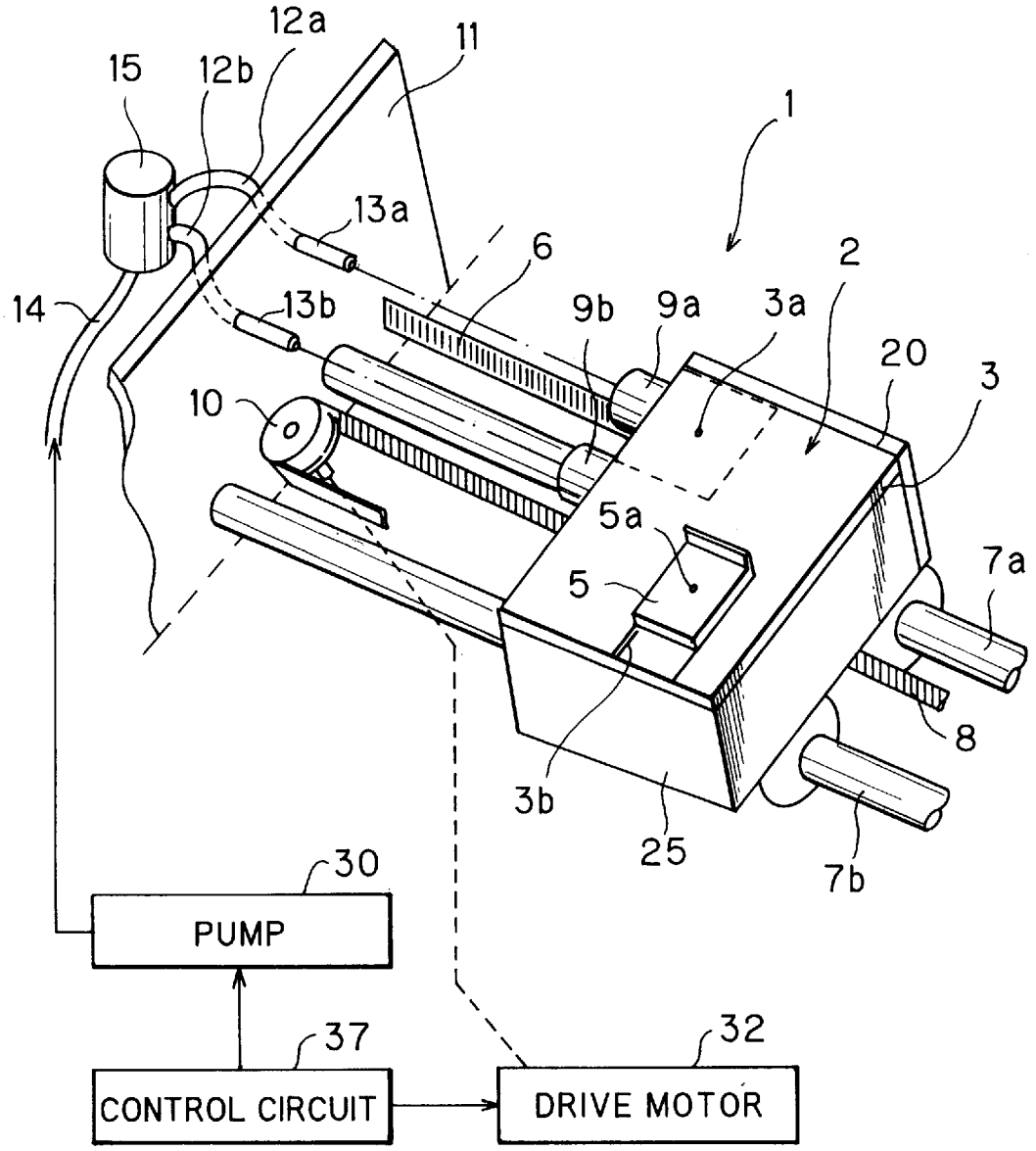
FIG. 1 is a perspective view showing a print head and ambient components in an ink jet printer according to one embodiment of the present invention.

As shown in FIG. 1, the printer 1 includes a print head 2 having an ink tank 25 and a nozzle/manifold plate 20. The print head 2 is slidably mounted on shafts 7*a* and 7*b*, which are supported at one end on a side wall 11. An endless belt 8 and a pulley 10 are provided for transmitting driving force of a drive motor 32 to the print head 2 so that the print head 2 can be slidingly driven along the shafts 7*a* and 7*b*. An encoder 6 is provided for detecting the position of the print head 2. The drive motor 32, the pulley 10 and the endless belt 8 constitute a drive mechanism.

Tubular stems 13*a* and 13*b* for feeding compressed air to the ink tank 25 during purging operations are fixed to the side wall 11. Air tubes 12*a* and 12*b* are connected to one end of the stems 13*a* and 13*b*, respectively, to fluidly connect the stems 13*a* and 13*b* with a compressed air divider 15. A pressurizing pump 30 is connected to the compressed air divider 15 by a tube 14. A control circuit 37 is provided for controlling operation of the pressurizing pump 30 and the drive motor 32. The pressurizing pump 30, the tube 14, the compressed air divider 15, the air tubes 12*a*, 12*b* and the tubular stems 13*a*, 13*b* constitute a pressure supplying means.

Air inlet ports 9*a* and 9*b* are provided at the ink tank 25. Further, a lid 3 is provided for covering an open end of the tank 25. The lid 3 is formed with breathe hole 3*a*. The lid 3 is provided with an ink supply port 3*b* which is covered by a movable cover 5 where a breathe hole 5*a* is formed.

Figure 2:
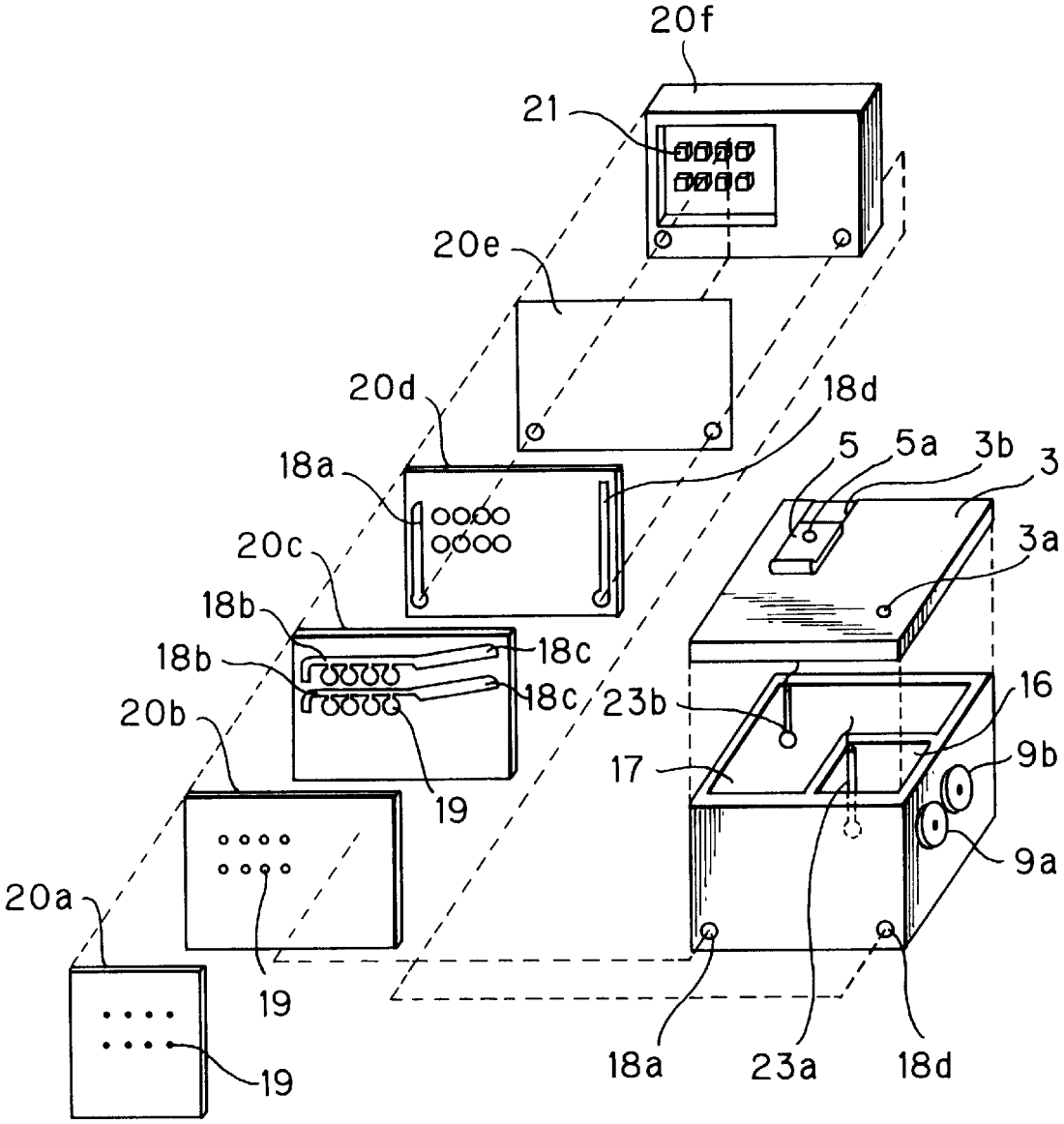
FIG. 2 is an exploded perspective view showing segments constituting a print head of the ink jet printer of FIG. 1.

As shown in FIG. 2, the ink tank 25 is divided into a main tank 17 and a sub tank 16 which share in common two outer walls of the ink tank 25. The nozzle/manifold plate 20 is attached to an outer surface of one of the common outer walls of the ink tank 25. The air inlet ports 9*a* and 9*b* are provided to the other common outer wall of the ink tank 25 for introducing air into the sub tank 16 and the main tank 17, respectively. That is, the inlet ports 9*a* and 9*b* are engageable with the tubular stems 13*a*, 13*b* when the print head 2 is moved adjacent to the side wall 11.

Ink level sensors 23*a* and 23*b* are provided in the sub tank 16 and a main tank 17, respectively, for detecting the amount of ink remaining therein. When the amount of residual ink drops to a predetermined level during printing or bubble purge, the sensors 23*a* and 23*b* will detect reductions in residual ink. Incidentally, the maximum ink level in these tanks 16 and 17 should be lower than the level of the air inlet ports 9*a* and 9*b* so as to avoid ink leakage from these ports 9*a* and 9*b* during printing operation.

The lid 3 covers both the sub tank 16 and the main tank 17. The openable ink supply port 3*b* is positioned above the main tank 17 so that the ink in the ink tank 25 can be replenished. Several minutes are required for ink levels in the main tank 17 and the sub tank 16 to reach equilibrium after replenishing ink through the ink supply port 3*b*. Several tens of minutes may be required in some cases. For example, when a hot-melt ink is replenished, a fairly long time is required for solid ink to melt. When it takes an unacceptably long time to reach equilibrium, about one half of the added and molten ink should be forced into the sub tank 16 by pressurizing the main tank 17 only.

The diameter of the breathe hole 5*a* is determined to suppress pressure loss from the main tank 17 to 10% when compressed air is supplied to the main tank 17. Similarly, the breathe hole 3*a* is formed to have a diameter that suppresses pressure loss in the sub tank to 10% when compressed air is supplied to the sub tank 16.

Figure 3:
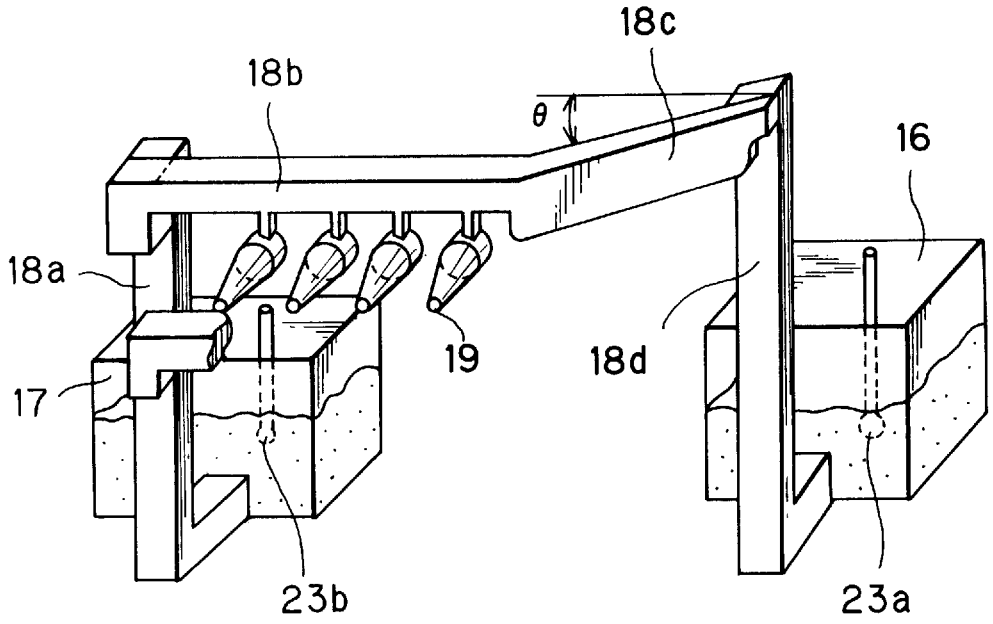
FIG. 3 is a schematic perspective view showing an ink passageway provided by the segments of FIG. 2 in the print head according to the embodiment.

As best shown in FIG. 2, the nozzle/manifold plate 20 includes nozzle components 20*a* through 20*f* formed with nozzles 19 and manifolds 18*a* through 18*d*. When the nozzle components 20*a* through 20*f* are assembled together and the nozzle/manifold plate 20 is connected to the ink tank 25, the manifolds 18*a* through 18*d* bring the nozzles 19 into fluid connection with the main tank 17 and the sub tank 16 to provide an ink passageway as shown in FIG. 3. Piezoelectric elements 21 for ejecting ink droplets are provided to the manifold plate 20*f* at a position corresponding to each nozzle 19.

As shown in FIG. 3, the manifold 18*a* is connected to the main tank 17 and the manifold 18*d* is connected to the sub tank 16. The manifold 18*b*, which is provided with the nozzles 19, is connected at one end to the manifold 18*a* at the opposite end to the manifold 18*c*. The manifold 18*c* is disposed between the manifold 18*b* and the manifold 18*d*. The manifold 18*c* extends upwardly at an angle with respect to the manifold 18*b* as shown in FIG. 3 so as to provide a predetermined angle theta with respect to a horizontal line. By disposing the manifold 18*c* at angle theta, bubbles, which tend to float upward in ink, will tend to move rightward, as viewed in FIG. 3, in the manifold 18*c* with ink flow from the main tank 17 even during normal printing. Bubbles will therefore collect at the upper end of the manifold 18*c* during printing so that they can be more effectively purged when ink is forced to flow from the main tank 17 to the sub tank 16 during bubble purge.

The tubular stems 13*a* and 13*b* and the air inlet ports 9*a* and 9*b* will be described while referring to FIGS. 4(*a*) through 4(*c*). Both of the tubular stems 13*a* and 13*b* have the same configuration. That is, the stem 13*a* is tubular with one opening connected to the air tube 12*a* as mentioned above. In a manner to be described later, the other opening of the stem 13*a* can be brought into connection with the air inlet port 9*a* by movement of the print head 2. The stem 13*a* is provided with a spring 35*a* and a ball 34*a*, both fitted in its hollow center. The spring 35*a* urges the ball 34*a* to close an air-outlet side opening of the stem 13*a*.

Similarly, the stem 13*b* is tubular with one opening connected to the air tube 12*b*. In a manner to be described later, the other opening of the stem 13*b* can be brought into connection with the air inlet port 9*b* by movement of the print head 2. The stem 13*b* is provided with a spring 35*b* and a ball 34*b*, both fitted in its hollow center. The spring 35*b* urges the ball 34*b* to close an air-outlet side opening of the stem 13*b*.

The air inlets 9*a* and 9*b* are configured slightly differently from each other. The air inlet 9*a* is formed with an air hole 31*a* and a pin 33*a*. The air hole 31*a* fluidly connects the air inlet 9*a* with the sub tank 16. The pin 33*a* is disposed to protrude toward the air-outlet side opening of the stem 13*a*. The air inlet 9*b* is formed with an air hole 31*b*, a pin 33*b*, and a valve 36. The air hole 31*b* fluidly connects the air inlet 9*b* with the main tank 17. The pin 33*b* protrudes toward the air-outlet side opening of the stem 13*b*. However, the pin 33*b* is slightly longer than the pin 33*a*, so it protrudes slightly further than the pin 33*a*. The valve 36 is adapted for closing up the air-outlet side opening of the stem 13*b* in a manner to be described later. The springs 35*a*, 35*b*, the balls 34*a*, 34*b*, the pins 33*a*, 33*b* and the valve 36 constitute a pressure connection means.

Figure 4A:
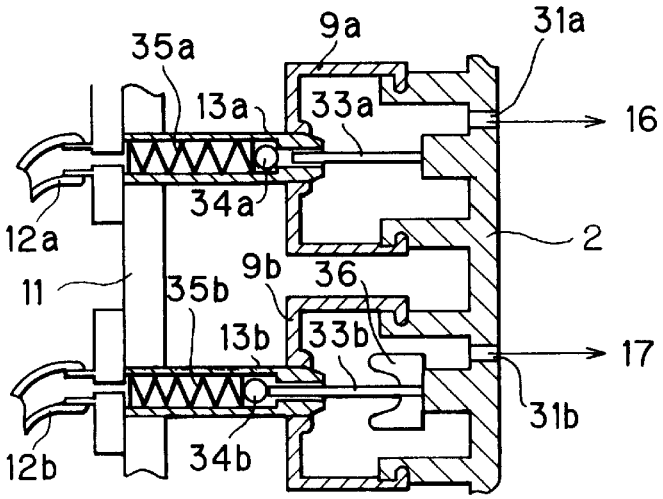
FIG. 4(*a*) through FIG. 4(*c*) are cross-sectional views showing a valve system used for purging bubbles from the print head, wherein FIG. 4(*a*) shows the valve system in a first position, FIG. 4(*b*) shows the valve system in a second position, and FIG. 4(*c*) shows the valve system in a third position.
Figure 4B:
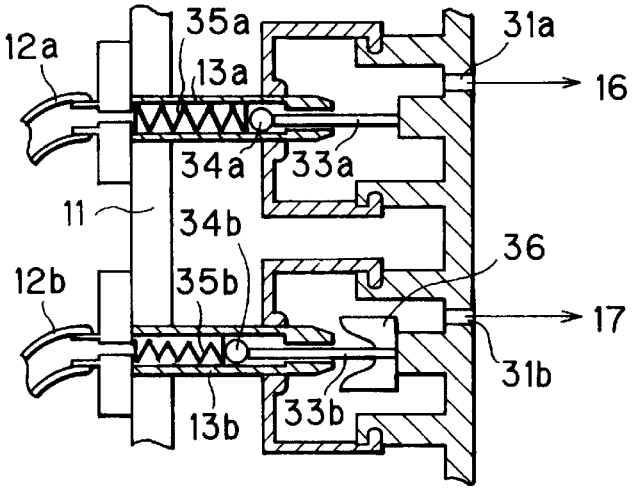
Figure 4C:
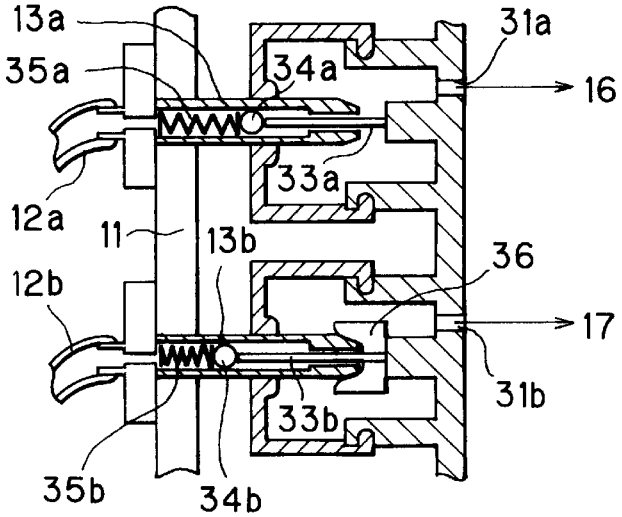

When the drive motor 32 is rotated in response to a purge signal from the control circuit 37, the print head 2 is moved toward sidewall 11, through the pulley 10 and the endless belt 8, into a first position, a second position, and a third position shown in FIGS. 4(*a*), 4(*b*), and 4(*c*), respectively. When the print head 2 moves into the first position, the pin 33*b* presses the ball 34*b* away from the air-outlet side opening of the stem 13*b* against the biasing force of the spring 35*b*, bringing the pressurizing pump 30 (FIG. 1) and the main tank 17 into fluid communication with each other. Because the pin 33*a* is shorter than the pin 33*b*, the air outlet side opening of the stem 13*a* is maintained closed by the ball 34*a*. Therefore, no fluid communication is provided between the pressurizing pump 30 and the sub tank 16. As a result, compressed air is supplied into the main tank 17 only.

As shown in FIG. 4(*b*), when further drive of the motor 32 moves the print head 2 toward the side wall 11 and into the second position, the pin 33*a* reaches the ball 34*a* and presses the ball 34*a* away from the air-outlet side of the stem 13*a* against the biasing force of the spring 35*a*. Also, the pin 33*b* presses the ball 34*b*. This brings the pressurizing pump 30 and the sub tank 16 into fluid connection, while the pressurizing pump 30 remains in fluid connection with the main tank 17. Accordingly, compressed air is supplied from the stem 13*a* and 13*b* to the sub tank 16 and the main tank 17, respectively, so that the pressure in both the sub tank 16 and the main tank 17 rises.

As shown in FIG. 4(*c*), when further drive of the motor 32 moves the print head 2 toward the side wall 11 and into the third position, the pin 33*a* further presses the ball 34*a* against the urging force of the spring 35*a* so that the pressurizing pump 30 remains in fluid connection with the sub tank 16. However, in the third position, the pin 33*b* has also been further moved, so that the valve 36 abuts against the tip end face of the stem 13*b*, thereby blocking fluid connection between the pressurizing pump 30 and the main tank 17. As a result, in the third position, compressed air is supplied only into the sub tank 16.

Next bubble purging operation will be described with reference to a flowchart shown in FIG. 5 and a time chart shown in FIGS. 6(*a*) through 6(*c*). Prior to the bubble purging operation, as shown in FIG. 6(*a*), pneumatic pressure level (first purging pressure) P1, pressurizing period (first purging period) t1, non-pressurizing intervals, and numbers of pressurization (in the illustrated embodiment three times) those having being experimentally obtained with respect to the main tank 17 are inputted into the control circuit 37 for forcibly introducing ink in the main tank 17 toward the sub tank 16 in order to concentrate or accumulate bubbles at the upper portion of the slanting manifold 18*c*.

Further, as shown in FIG. 6(*b*), pneumatic pressure level (third purging pressure) P3, pressurizing period (third purging period) t3, non-pressurizing intervals, and numbers of pressurization (in the illustrated embodiment three times) those having being experimentally obtained with respect to the sub tank 16 are inputted into the control circuit 37 for returning the ink in the sub tank 16 to the main tank 17 while maintaining the concentrated bubbles at the slanting manifold 18*c*. In this case, the pressurizing cycle is determined such that pressurizing timing t1 is not overlapped with the pressurizing timing t3 to ensure that the main tank 17 and the sub tank 16 are alternately pressurized. Furthermore, the pressure level P3 and pressurizing period t3 are determined such that the pressure P1 is greater than the pressure P3, and the pressurizing period t3 is longer than the pressurizing period t1 to insure that the same amount of ink flows from the main tank 17 into the sub tank 16 and vice versa while maintaining bubbles at the slanting manifold 18*c*.

Furthermore, as shown in FIG. 6(*c*), pressure level (second purging pressure) P2 and pressurizing period (second pressurizing period) t2 and numbers of pressurization (in the illustrated embodiment once) are beforehand inputted into the control circuit 37 so as to apply pneumatic pressure to both main tank 17 and the sub tank 16 in order to discharge bubbles located at the tip portions of the nozzles 19 and at the manifold 18*c* to the outside of the nozzles.

Figure 5:
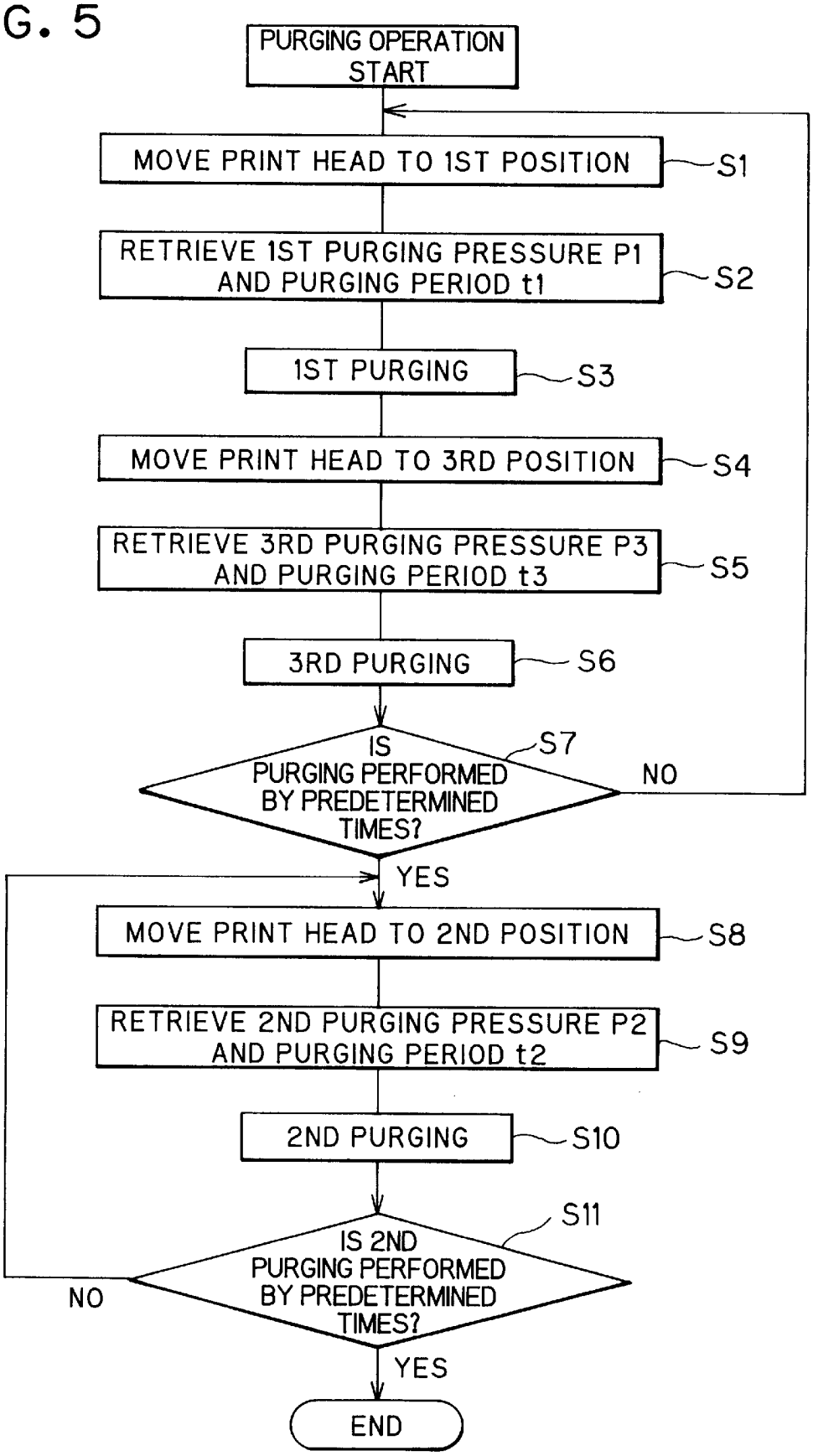
FIG. 5 is a flowchart representing operations for purging bubbles from the print head.

In the flowchart shown in FIG. 5, Steps S1 through S7 concern alternating pressurization with respect to the main tank 17 and the sub tank 16. That is, in Step S1, the print head 2 is moved into the first position as shown in FIG. 4(*a*) where the pressurizing pump 30 and the main tank 17 are brought into fluid connection so that compressed air can be supplied to the main tank 17 only. Then in Step S2, purging pressure P1 and the pressurizing period t1 are retrieved. Then, the routine goes into Step S3 for pressurization which corresponds to the first pulse in FIG. 6(*a*). As the pressure in the main tank 17 rises, only 10% of the pressure increase will be lost by discharge of air from the breathe hole 4*b*. When the pressure in the main tank 17 rises, ink will be forced from the main tank 17 into the manifold 18*a*. The ink then passes into the manifold 18*b*, where a part of the ink may be ejected from the nozzles 19. Most of the ink, however, passes through manifolds 18*b* through 18*d*, to be collected in the sub tank 16. Air bubbles mixed with the ink will be collected at the upper portion of the manifold 18*c* because of buoyancy. Therefore, most of the ink will be flowed into the sub tank 16.

Accordingly, loss of ink is suppressed while purging bubbles from the ink. The supply of compressed air is stopped upon elapsing the period t1. At this point, the level of ink in the sub tank 16 is higher than the level in the main tank 17. Differences in pressure heads between the ink in the sub tank 16 and the main tank 17 will slowly force ink to flow back from the sub tank 16 to the main tank 17 until the pressure heads in the sub tank 16 and the main tank 17 reach equilibrium. However, it is necessary to speed this process by forcing the excess ink collected in the sub tank 16 back to the main tank 17.

Therefore, in Step S4, the print head 2 is moved from the first position to the third position shown in FIG. 4(*c*) so that the pressurizing pump 30 and the sub tank 16 come into fluid connection. Then in Step S5, the pressure level P3 and pressurizing period t3 are retrieved, and in Step S6, actual purging operation is performed which corresponds to a first pulse in FIG. 6(*b*). In this case, compressed air is supplied to the sub tank 16 only, and pressure in the sub tank 16 rises. At this time, there will be a pressure loss of about 10% because a part of the compressed air is discharged form the breathe hole 3*a*.

When the pressure in the sub tank 16 rises, ink from the sub tank 16 flows back to the main tank 17 via the manifolds

18*d*, 18*c*, 18*b*, and 18*a*. Then in Step S7 judgment is made as to whether or not the predetermined numbers of alternating purging operations have been performed. Since the fist purging and the third purging were conducted once, respectively, the routine goes back to the Step S1 for repeating the Steps S2 through S7. Therefore, the pressurization is successively performed in the order to second pulse of FIG. 6(*a*), second pulse of FIG. 6(*b*), third pulse of FIG. 6(*a*) and third pulse of FIG. 6(*b*). When the pressurization is performed by six times, the judgment in Step S7 falls Yes, and the routine goes into Step S8.

The reason of alternating purging operation S1 through S3 and S4 through S6 will be described. Decreasing the cross-sectional area of manifolds 18*a* and 18*b* fluidly connecting the main tank 17 with the nozzles 19 will reduce the volume of the manifolds 18*a* and 18*b*, thereby increasing the flow speed produced when a set pressure is applied to the main tank 17. This enhances the efficiency of bubble purging operations. However, providing the manifolds 18*a* and 18*b* with larger cross-sectional area would smooth supply of ink during printing.

Taking the contradicting requirement into consideration, pressure difference P1 and P3 is provided. Surface tension of the bubbles may cause the bubble to be adhered onto a fluid passage wall such as an inner surface of the manifold 18. To remove the bubble from the passage wall, in the bubble purge operation, bubbles can be aggressively purged from out of the manifold 18 during pressurization of the main tank 17 because the main tank 17 is pressurized to a high pressure P1 which is greater than surface tension. Increasing the pressure to the level P1 can compensate the reduction in flow speed which may occur in providing sufficiently large cross-sectional area of the manifold 18 for smooth ink supply to the nozzles 19 for the purpose of printing operation.

On the other hand, only ink will flow into the manifold 18*b* from the sub tank 16 during pressurization of the sub tank 16 because the low pressure P3 in the sub tank 16 will only produce a slow flow speed in the manifold 18*c*. The slow flow speed will be insufficient to force bubbles in the manifold 18*c* downward. The bubbles will therefore be still retained at the upper tip of the manifold 18*c*. Also, this repeated back and force ink flowing process will insure that bubble purge operations do not result in only one of the tanks being filled. Bubbles can be successfully purged in a short period of time.

If bubble purging operation in Steps S3 and S6 is repeatedly performed by predetermined times, i.e. three times (S7:Yes), the routine goes into Step S8. In Step S8, the print head 2 is moved to the second position shown in FIG. 4(*b*) where both the main tank 17 and the sub tank 16 are brought into fluid connection with the pressurizing pump 30. Then in Step S9, the pressure level P2 and pressurizing period t2 are retrieved, and in Step S10, purging operation is performed. In the Step S10, bubbles accumulated in the nozzle tips and upper portion of the slanting manifold 18*c* can be effectively discharged from the nozzles 19 by applying the same pressure P2 for the same purging time t2 to both the main tank 17 and the sub tank 16 as shown in FIG. 6(*c*). Then, in Step S11, judgment is made as to whether or not the purging is performed by predetermined times. If judgment falls Yes, the program is ended, and if the judgment falls No, routine returns back to the Step S8.

Because only the Step S10 will discharge ink outside through the nozzles 19 in purging operation. In other words, the Steps S3 and S6 do not cause positive ink discharge through the nozzles 19. Therefore, ink wasting amount in purging operation can be reduced. In other words, in the depicted embodiment, the main tank 17 and the sub tank 26 are selectively pressurized to purge bubbles from manifolds and nozzles, so that bubbles can be accumulated or concentrated to the upper portion of the manifold 18*c*. Therefore, ink need not be wasted for removing bubbles as is the case in conventional units. Bubbles in the manifolds and in the nozzles can be purged economically with much less wasted ink because in the Step S10, almost all air bubbles which have been mixed with the ink are congregated at a position adjacent to the nozzles 19.

In this way, bubble purge operations can be performed using movement of the print head and using an inexpensive structure having very few parts, that is, having a valve provided to a print head portion and to a single pressurizing pump.

While the invention has been described in detail with reference to specific embodiments thereof, it would be apparent to those skilled in the art that various changes and modifications may be made therein without departing from the spirit and scope of the invention. For example, when the print head is provided with several main tanks for multicolor printing, the air branching manifold described in Japanese Utility Model Application Kokai No. HEI-5-12042 can be used. Further, because in the present invention, the main tank 17 only, the sub tank 16 only, or both the main tank 17 and the sub tank 16 can be selectively pressurized, various purging sequences are possible by selectively moving the print head 2 between the three positions shown in FIGS. 4(*a*) through 4(*c*) to minimize ink wasting amount.

What is claimed is:

1. An ink jet printer for ejecting ink from nozzles, the ink jet printer comprising:

a print head having a main tank for storing ink, a sub tank for collecting and storing ink, and a manifold fluidly connecting the main tank and the sub tank, the manifold being in fluid communication with the nozzles for supplying ink from the main tank to the nozzles, the manifold having a bubble concentrating space in a part which is the highest among a remaining part of the manifold, the main tank and the sub tank;

a drive mechanism for reciprocally moving the print head in a line extending direction for printing, wherein the drive mechanism provides the print head with a range of movement that includes first, second and third purging positions for selectively performing first, second and third purging operation, respectively; and introduction means for introducing a compressed gas selectively to the main tank only for flowing the ink in the main tank to the sub tank, to the sub tank only for flowing back the ink in the sub tank to the main tank, and to both the main tank and the sub tank for ejecting, through the nozzles, the bubbles concentrated at the bubble concentrating space in accordance with a position of the print head provided by the drive mechanism, wherein the introduction means comprises:

pressure supplying means for supplying compressed gas to the main tank and the sub tank;

pressure connection means for fluidly connecting the pressure supplying means with selected one of the main tank and the sub tank and both the main tank and the sub tank responsive to the purging position of the print head, wherein the ink in the main tank flows into the sub tank when the pressure supplying means and the main tank are connected to each other in the first purging operation, and the ink in the sub tank flows back to the main tank when the pressure supplying means and the sub tank are connected to each other in the third purging operation, and the pressure supplying means is connected to both the main and sub tanks in the second purging operation; and control means connected to the drive mechanism, the pressure supplying means and the pressure connection means for providing one of the purging positions of the print head and for changing purging pressure and purging period provided by the pressure supplying means in accordance with the purging position.

2. The ink jet printer as claimed in claim 1, wherein the control means controls the drive mechanism for moving reciprocally the print head between the first and third purging positions, so that the compressed gas from the pressure supplying means is alternately introduced into the main tank and the sub tank so as to flow the ink back and forth between the main tank and the sub tank for collecting bubbles in the ink at the bubble concentration space of the manifold.

3. The ink jet printer as claimed in claim 2, wherein the control means further controls the drive mechanism for moving the print head to the second purging position so that the compressed gas is applied to both the main tank and the sub tank for positively discharging the bubbles in the bubble concentration space and in the nozzles out of the print head.

4. The ink jet printer as claimed in claim 2, wherein the control means controls the pressure supplying means to generate a first purging pressure for a first purging period in the first purging operation, and controls the pressure supplying means to generate a third purging pressure lower than the first purging pressure for a third purging period longer than the first purging period in the third purging operation for maintaining bubbles in the bubble concentration space even during flow of the ink toward the main tank.

5. The ink jet printer as claimed in claim 4, wherein the print head comprises:

an ink tank member having an outer wall, and an internal partition wall which divides an interior of the ink tank member into the main tank and the sub tank, the outer wall being formed with a first air inlet port in fluid communication with the sub tank and a second inlet port in fluid communication with the main tank; and a nozzle/manifold plate attached to the outer wall of the ink tank at a position other than the first and second inlet ports, the nozzle/manifold plate forming therein the manifold and the nozzles in communication with the main tank.

6. The ink jet printer as claimed in claim 5, wherein the manifold comprises a first vertical manifold in fluid communication with the main tank, a second vertical manifold in fluid communication with the sub tank, and a horizontal manifold for providing fluid communication between the first and second vertical manifolds, the nozzles being provided at the horizontal manifold, the horizontal manifold having a slanting portion slanting upward in a direction toward the second vertical manifold for providing the bubble concentration space.

7. An ink jet printer for ejecting ink from nozzles, the ink jet printer comprising:

a side wall member;

a print head having a main tank for storing ink, a sub tank for collecting and storing ink, and a manifold fluidly connecting the main tank and the sub tank, the manifold being in fluid communication with the nozzles for supplying ink from the main tank to the nozzles;

a drive mechanism for reciprocally moving the print head in a line extending direction for printing, the drive mechanism further providing the print head with a range of movement that includes first, second and third purging positions with respect to the side wall member for selectively performing first, second and third purging operation; and pressure supplying means for supplying compressed gas to the main tank and the sub tank; and pressure connection means for fluidly connecting the pressure supplying means with one of the main tank and the sub tank and both the main tank and the sub tank responsive to the purging position of the print head, wherein the ink in the main tank flows into the sub tank when the pressure supplying means and the main tank are connected to each other in the first purging operation, and the ink in the sub tank flows back to the main tank when the pressure supplying means and the sub tank are connected to each other in the third purging operation, and the pressure supplying means is connected to both the main and sub tanks in the second purging operation; and control means connected to the drive mechanism, the pressure supplying means and the pressure connection means for controlling purging of the print head.

8. The ink jet printer as claimed in claim 7, wherein the control means controls the drive mechanism for moving reciprocally the print head between the first and third purging positions, so that the compressed gas from the pressure supplying means is alternately introduced into the main tank and the sub tank so as to flow the ink back and forth between the main tank and the sub tank for collecting bubbles in the ink at an upper portion of the manifold.

9. The ink jet printer as claimed in claim 8, wherein the control means further controls the drive mechanism for moving the print head to the second purging position so that the compressed gas is applied to both the main tank and the sub tank for positively discharging the bubbles in the upper portion of the manifold and nozzles out of the print head.

10. The ink jet printer as claimed in claim 9, wherein the control means controls the pressure supplying means to generate a first purging pressure for a first purging period in the first purging operation, and controls the pressure supplying means to generate a third purging pressure lower than the first purging pressure for a third purging period longer than the first purging period in the third purging operation.

11. The ink jet printer as claimed in claim 10, wherein the print head comprises:

an ink tank member having an outer wall, and an internal partition wall which divides an interior of the ink tank member into the main tank and the sub tank, the outer wall being formed with a first air inlet port in fluid communication with the sub tank and a second inlet port in fluid communication with the main tank; and a nozzle/manifold plate attached to the outer wall of the ink tank at a position other than the first and second inlet ports, the nozzle/manifold plate forming therein the manifold and the nozzles in communication with the main tank.

12. The ink jet printer as claimed in claim 11, wherein the manifold comprises a first vertical manifold in fluid communication with the main tank, a second vertical manifold in fluid communication with the sub tank, and a horizontal manifold for providing fluid communication between the first and second vertical manifolds, the nozzles being provided at the horizontal manifold.

13. The ink jet printer as claimed in claim 12, wherein the horizontal manifold has a slanting portion slanting upward in a direction toward the second vertical manifold for retaining bubbles in the slanting portion when the ink is forcibly flows from the main tank to the sub tank during alternating first and third purging operation.

14. The ink jet printer as claimed in claim 13, wherein the pressure supplying means comprises: a compressed air source, and a branching means connected to the compressed air source for providing a first tubular member and a second tubular member, the first and second tubular members being fixed to the side wall member.

15. The ink jet printer as claimed in claim 14, wherein the pressure connection means comprises:

a first valve mechanism provided in association with the first tubular member and the first air inlet port for providing fluid communication between the compressed air source and the sub tank in accordance with second and third purging positions of the print head; and a second valve mechanism provided in association with the second tubular member and the second inlet port for providing fluid communication between the compressed air source and the main tank in accordance with the first and second purging position of the print head.

16. The ink jet printer as claimed in claim 15, wherein the second purging position is positioned closer to the side wall member than is the first purging position, and the third purging position is positioned closer to the side wall member than is the second purging position.

17. The ink jet printer as claimed in claim 16, wherein the first valve mechanism comprises:

a first biasing spring disposed in the first tubular member;

a first ball based by the first biasing spring to normally close a first open end of the first tubular member;

a first rod extending from the ink tank member and insertable into the first open end for opening the first open end to provide a fluid communication between the first tubular member and the first air inlet port when the print head is moved to the second and the third purging positions;

a second biasing spring disposed in the second tubular member;

a second ball biased by the second biasing spring to normally close a second open end of the second tubular member;

a second rod extending from the ink tank member and insertable into the second open end for opening the second open end to provide a fluid communication between the second tubular member and the second air inlet port when the print head is moved to the first and second purging positions, the second rod being longer than the first rod; and a cap member provided at a base end of the second rod for closing the second open end when the print head is moved to the third purging position.

* * * * *